US006531190B1

(12) United States Patent
Malvaranta

(10) Patent No.: US 6,531,190 B1
(45) Date of Patent: Mar. 11, 2003

(54) CONTROL METHOD FOR QUALITY FACTORS OF THE SURFACE OF WHOLE WOOD

(75) Inventor: Pertti Tapani Malvaranta, Espoo (FI)

(73) Assignee: Altonic Oy, Hameenlinna (FI)

( * ) Notice: Subject to any disclaimer, the term of this patent is extended or adjusted under 35 U.S.C. 154(b) by 0 days.

(21) Appl. No.: 09/959,491

(22) PCT Filed: Apr. 28, 2000

(86) PCT No.: PCT/FI00/00378

§ 371 (c)(1),
(2), (4) Date: Feb. 8, 2002

(87) PCT Pub. No.: WO00/66335

PCT Pub. Date: Nov. 9, 2000

(30) Foreign Application Priority Data

Apr. 29, 1999 (FI) ..... 990975

(51) Int. Cl.[7] ..... B05D 3/00

(52) U.S. Cl. ..... 427/532; 427/398.1; 427/421; 427/551; 427/553; 427/557

(58) Field of Search ..... 427/532, 551, 427/553, 557, 421, 398.1

(56) References Cited

U.S. PATENT DOCUMENTS

| | | | |
|---|---|---|---|
| 3,690,922 | A | 9/1972 | Dombay |
| 5,967,207 | A | 10/1999 | Chen |

FOREIGN PATENT DOCUMENTS

| | | | |
|---|---|---|---|
| CN | 1114605 | A | 1/1996 |
| DE | 1792211 | | 8/1968 |
| DE | 42 06 021 | A1 | 9/1993 |
| FR | 2 639 282 | | 5/1990 |
| FR | 2 754 755 | | 4/1998 |
| JP | 50082206 | | 7/1975 |
| JP | 57087302 | A | 5/1982 |
| JP | 57212005 | | 12/1982 |
| JP | 58148720 | | 9/1983 |
| JP | 60008008 | A | 1/1985 |
| JP | 60027501 | | 2/1985 |
| JP | 3021403 | A | 1/1991 |
| JP | 03065301 | A | 3/1991 |
| JP | 05169406 | | 7/1993 |
| JP | 5169406 | A | 7/1993 |
| JP | 06134712 | | 5/1994 |

*Primary Examiner*—Bernard Pianalto
(74) *Attorney, Agent, or Firm*—Young & Thompson

(57) ABSTRACT

The invention relates to a method for adjusting the quality factors of the surface of a piece of wood, so that the effective period of hydrogen peroxide, from its application onto the wood surface to its evaporation therefrom is less than 5 minutes, advantageously less than 1 minute. In the method onto the surface of the piece of wood, with a temperature near room temperature or lower, there is fed hydrogen peroxide as spray, the pH of the initial solution of said spray being neutral or acidic. The hydrogen peroxide is allowed to affect the wood surface about 1–60 seconds, advantageously about 1–30 seconds. Thereafter the hydrogen peroxide is activated by irradiating the surface of the piece of wood by a radiation source, so that at the end of the irradiation period, the wood surface temperature is 40–80° C. The power of the radiation source is 20–500 kW, advantageously 50–200 kW per surface $m^2$ of the piece of wood.

13 Claims, 1 Drawing Sheet

CONTROL METHOD FOR QUALITY FACTORS OF THE SURFACE OF WHOLE WOOD

CROSS REFERENCE TO RELATED APPLICATION

This is the 35 USC 371 National Stage of International Application PCT/FI00/00378 filed on Apr. 28, 2000, which designated the United States of America.

FIELD OF THE INVENTION

The invention relates to a method for adjusting the quality factors of whole wood surfaces.

BACKGROUND OF THE INVENTION.

Whole wood is used in building and furniture industry as plywood, board, solid wood, construction wood and plates. Usually whole wood contains colour defects that must be removed in order to enable industry to utilise said wood. Among others, there may be uneven colouring, non-desired colouring as well as discolorations created during the drying process. As regards thermally treated wood, for instance, it is usually necessary to even out the shade differences of the wood surface. At present whole wood colour defects are usually removed mechanically, because the field is lacking an effective and sufficiently rapid method for adjusting whole wood colour defects which would also maintain the strength properties of the wood in question. In addition to removing colour defects, the industry also needs the adjusting of other factors that affect the colour shades of whole wood.

In non-industrial scale, whole wood colour defects have been removed by using various bleaching methods, where the process conditions depend on the type of wood in question, its hardness, purpose of use etc. Particularly as regards North-European wood species, however, there are very few economical and for mass production sufficiently rapid and effective colour defect removing methods available for the carpentry and building industry. Another remarkable drawback with known methods for adjusting whole wood colour defects is that they cannot effectively adjust other quality factors of whole wood surfaces, i.e. surface hardness and other factors affecting the colour shades of the surface, but they are exclusively concentrated on adjusting individual quality parameters, such as lightness. In part the latter is due to the fact the current whole wood bleaching methods are too slow for achieving an adequately controllable adjusting method for whole wood surface shades.

Whole wood colour shades are adjusted by bleaching the wood surface to a desired lightness, uniformity of colour and reflectivity. The most important bleaching chemicals used in the bleaching of whole wood have been ozone, Na chlorite, Na hypochlorite and hydrogen peroxide. A good, industrially usable whole wood bleaching chemical should be economic, as ecological as possible and safe in use. At present the general tendency is to give up chlorine-based bleaching agents owing to their environmental hazards, and as regards ozone, it is expensive an technically difficult to use. Ammonia has also been used to some extent, but its use has been limited owing to health hazards. Among the above mentioned bleaching chemicals, only hydrogen peroxide fulfils all of the mentioned criteria: as an industrial chemical agent, it is generally available, fairly economic, ecological and safe in use.

In the prior art, hydrogen peroxide has usually been used for bleaching whole wood in alkaline conditions. The bleaching effect of hydrogen peroxide in alkaline conditions is mainly based on the effect of the perhydroxyle HOO ion that reduces the quinoid structures of cellulose. The efficiency of hydrogen peroxide bleaching in alkaline conditions depends on the temperature according to the Arrhenius' rule $k=Ae^{-RT}$, in which case a rise in the temperature increases reaction speed. However, raising the temperature also softens the wood material; this is due to the breaking-up reactions of carbohydrates, caused by the alkaline conditions. With respect to industrial bleaching of whole wood, it is extremely difficult with hydrogen peroxide to obtain both a bleaching time that is sufficiently short and simultaneously an adequate bleaching efficiency, in order to achieve a desired bleaching capacity and result. If the bleaching temperature is raised in order to increase the processing capacity and to ensure bleaching efficiency, we are fairly soon faced with problems relating to the physical properties of the wood material, for instance surface hardness.

The company Finnish Peroxides Oy recommends that whole wood hydrogen peroxide bleaching should be carried out at the pH value 11, in the presence of a sodium silicate stabiliser. The bleaching temperature is 60° C., and the bleaching takes place by immersing the wood in the solution for the duration of 60 minutes. This type of bleaching method is well suited for the bleaching of individual wood products, but as regards such furniture and carpentry industry that operates on a mass-production scale, the processing time is far too long. From the U.S Pat. No. 3,690,922 there is known a bleaching method for whole wood or plywood, in which method chromophoric groups are first attempted to be eliminated by oxidising them in the pre-treatment step with a persulphate solution that also contains surface active and buffering agents. After eliminating the chromophoric groups, the wood is treated with another bleaching agent, such as hypochlorite or hydrogen peroxide solution. After the described steps, there are carried out wood tempering, pH adjustment and wood drying steps. In an industrial scale, the drawback with this kind of process is its slowness, its multiple steps as well as the use of several different chemicals, which increases the operating expenses.

Owing to the length of the required bleaching period, it has been attempted to intensify the bleaching effect of hydrogen peroxide in several different methods by means of several different hydrogen peroxide activators. In the DE patent publication 1,792,211, the employed activator is ammonia and sodium carbonate, in the SE publication 325,124 the employed hydrogen peroxide activator in the overpressure bleaching of veneer doors is ammonia, and in the patent publication U.S. Pat. No. 3,708,889, ammonia is used both as a bleaching activator and a bleaching agent. Although the use of a bleaching activator solves many problems in hydrogen peroxide bleaching, an increase in the use of bleaching chemicals and a resulting increase in the operating expenses may still easily become a problem.

In several cases, it has been attempted to perform hydrogen peroxide treatment in acidic conditions, at a raised temperature without any activators that increase the chemical costs. One of these methods is the bleaching method known from a FR patent publication, wherein wood that has become greyish is immersed in a hydrogen peroxide solution in acidic conditions for a relatively short period. However, in order to ensure the uniformity of the bleaching result, the wood must in this process be pressure treated twice, which makes the method remarkably more complicated and increases the processing expenses.

Among the above described known methods there are not set forth any such overall adjusting methods for whole wood surface quality factors that would be industrially suitable, simple and sufficiently rapid. Thus the main object of the present invention is to eliminate the drawbacks of the prior art as described above and to realize a particularly industrially suitable control method for wood surface quality factors, in this case colour shades and surface hardness.

SUMMARY OF THE INVENTION

The first object of the invention is to realize an adjustment method for wood surface colour shades, which method is expressly suitable for industrial-scale serial production, i.e. production that is carried out on a conveyor belt, in which method the process control factors that affect the surface colour shades (further on process control factors or, for the sake of simplicity, control factors) can be managed so, that the desired wood surface quality factors are achieved, said factors including the desired wood surface colour shades, i.e. lightness, uniformity of the shades and reflectivity of the surface, as well as a sufficient wood surface hardness, i.e. the physical strength properties of the wood. In industrial-scale mass production, the management of the control factors also is important because the quality factor requirements set for the wood may vary between different batches, in which case it must be known how the control factors should be changed in order to operate according to the changed quality requirements.

As regards industrial-scale mass production, where the production usually takes place on a conveyor belt or a corresponding line, the quality factor adjustment method must be sufficiently rapid Thus the second main object of the invention is to achieve a method that is suitable for industrial-scale mass production and provides a sufficiently rapid method for adjusting quality factors, in which method the wood surface obtains the desired colour shade in a short time and maintains the desired hardness. As regards the adjusting of whole wood quality factors in continuous industrial-scale mass production, the total effective period of hydrogen peroxide, starting with the spraying of hydrogen peroxide onto the wood surface, should be within the range of less than 3 minutes, advantageously about 10–30 seconds.

Another object of the invention is to realize an adjusting method of whole wood surface colour shades that is easily applicable in industry and as low as possible in chemical expenses, which method utilises cheap and generally abundantly available hydrogen peroxide for adjusting the colour shades. The cutting of the chemical expenses means that the purpose is to use as few bleaching chemicals and auxiliary agents as possible. Moreover, the chosen chemicals should be used in quantities that are as small as possible.

A further object of the invention is to realize an adjusting method for whole wood quality factors, where the surface treatment is carried out so that it improves the absorption capacity of the solvents and thus enables a more even distribution of pigments and paints onto the wood surface.

The invention is based on the realization that when aiming at a rapid and simple method for adjusting the quality factors of whole wood surfaces, it is necessary to manage a sufficiently large number of process control factors. In the method according to the invention, the wood surface quality factors can be adjusted as desired by means of several different control factors. This is a remarkable advantage with respect to the adjustability of the method and its suitability in industry, because the adjusting of the process quality factors is always the more precise, the more control factors there are in the process.

The method according to the invention for adjusting the quality factors of the surface of a piece of wood comprises at least the following steps:

on the surface of a piece of wood, having a temperature near room temperature or lower, there is fed hydrogen peroxide spray, the pH of the initial solution of said spray being neutral or acidic, the hydrogen peroxide is allowed to affect the wood surface for about 1 - 60 seconds, advantageously about 1–30 seconds, the hydrogen peroxide is activated by irradiating the piece of wood by a radiation source, so that at the end of the treatment period, the surface temperature of the piece is 40–80° C.

Advantageously the wood surface is irradiated by an IR radiation source with a maximum emission of 1–10 $\mu$m, advantageously 3–6 $\mu$m and power of 20–500 kW, advantageously 50–200 kW per $m^2$ of the wood surface.

In the method according to the invention, simultaneously with the heating of the wood surface, there is usually provided ventilation on the wood surface in order to cool off the wood surface and to evaporate the hydrogen peroxide, so that the effective time of hydrogen peroxide, from its activation to its evaporation, is of the order less than 5 minutes, advantageously less than 15 seconds.

The above described quality factor adjusting method can also be carried out as a so-called feed-back adjusting method that is well suited to mass production, according to the following description:

wood surface quality factors are measured, the measured values of the wood surface quality factors are compared to the set values of said quality factors, on the basis of the difference between the measured values and the set values of the quality factors, adjustments are made in the process control factors, said process control factors comprising one or more of the following: the quantity and temperature of the air fed onto the wood surface, the power of the radiation source, advantageously an IR radiation source, the period between the feeding and activation of hydrogen peroxide, the quantity and concentration of the hydrogen peroxide spray and the pH value of the hydrogen peroxide solution from which said spray was created.

after adjusting the process control factors, the wood surface quality factors are measured once or several times and compared with the set values of the quality factors, and on the basis of the difference between the measured and set values of the quality factors, the set values of the process are adjusted, until the desired wood surface quality factors are achieved.

always prior to measuring the quality factors, the wood surface temperature is adjusted to roughly room temperature or below it.

Here the measuring of the quality factors can be understood both as automatic measurement by a machine or measurement by the human eye.

The most important control factors of the quality factors that are used in the above described method are:

the heating power fed onto the wood surface per the area of the treated wood, the method of irradiation/heating of the wood surface (advantageously IR irradiation), the quantity of hydrogen peroxide fed onto the wood surface per the surface of the treated wood, the method of applying hydrogen peroxide (spraying), the hydrogen peroxide spraying temperature (room temperature or lower), the period between the hydrogen peroxide treatment and heating of the wood surface (generally adjusted at a conveying speed that is of the order 3–20 m/min), the concentration and pH value of hydrogen peroxide, the wavelength distribution and intensity, i.e. power per surface unit of wood, of the IR radiation used for activating the hydrogen peroxide, the properties of the air flow fed onto the wood surface (humidity of the air mass, fed quantity of air per unit of time, air temperature).

Said control parameters affect both the wood surface quality parameters and the effective time of hydrogen peroxide from its spraying onto the surface of the piece of wood to its evaporation from the surface thereof according to the following description:

By means of the power or intensity of the radiation source, advantageously an IR radiation source, and by means of the emission profile thereof, there are controlled the lightness of the wood surface and the uniformity of colour. In order to achieve a sufficiently short bleaching time and thus an adequately adjustable method for controlling the quality factors of the surface of whole wood, the maximum emission of the radiation source and particularly that of the IR radiation source must be such that it also emits visible light; a suitable maximum emission for an IR radiation source is 1–10 $\mu$m, advantageously 3–6 $\mu$m. Hydrogen peroxide is activated by irradiating the wood surface by a radiation source, advantageously an infrared radiation source with a power of 20–500 kW, advantageously 50–200 kW per square meter of wood to be bleached, while the wood surface temperature at the end of the irradiation period is about 40–80° C.

The IR radiation having the above mentioned maximum emission contains visible light that activates and decomposes hydrogen peroxide. By selecting a different IR radiation source, the emission profile of the radiation of the IR radiation source can be affected.

A radiator with a sufficient intensity, advantageously an IR radiator, is an important prerequisite for cutting the bleaching period (less than 5 minutes, advantageously less than 1 minute) enough with respect to industrial mass production. Hence in the method of the invention, there is applied a considerable overpower of the radiation source in relation to the usual radiation intensities applied in the field of surface treatment. Infrared radiation has remarkable advantages in comparison with other heating methods: wood absorbs heat best within the IR range, and the heat absorption takes place evenly. Owing to said properties, wood is heated rapidly, and its colour is easily adjusted to be of uniform quality. With IR radiation sources, the power can be adjusted for instance by adjusting the distance of the radiation source with respect to the surface of the piece of wood, or by means of the electric power of the radiation source.

The lightness of the wood surface, the uniform quality of the colours and the effective time of hydrogen peroxide, from its activation to its evaporation from the wood surface, are all adjusted by cooling the wood surface with an air flow simultaneously as it is heated. By using an air flow, it also is ensured that the wood surface is not overheated at any place. By adjusting the air quantity, air temperature and humidity, the heating conditions can be supervised, so that the evaporation of hydrogen peroxide from the wood surface takes place in a controlled fashion and in a desired time. By means of air blasting, also the starting point of the hydrogen peroxide bleaching in the process can be adjusted.

Air blasting brings forth other important advantages in the process: when the bleaching step is repeated several times, air blasting can be used as an effective cooler between the hydrogen peroxide spraying—(infrared) radiation—bleaching cycles. Owing to a cooling step in between the bleaching cycles, heat is effectively conducted from inside the wood onto the surface thereof, thus resulting in a better drying of the wood, which in part helps remove the hydrogen peroxide residues. A bleaching method divided into several bleaching and heating steps is advantageous for example when there is a risk that the wood surface could otherwise be softened due to the acidic bleaching conditions. Excessive hydrogen peroxide can be decomposed for instance by means of ultrasound, as well as underpressure evaporation at temperatures lower than normal. Usually, however, hydrogen peroxide needs not be decomposed after the surface irradiation/thermal treatment.

As is apparent from the above description, in the method according to the invention the effective time of hydrogen peroxide is controlled, from its activation to its evaporation, primarily by adjusting the temperature, humidity and quantity of air fed into the process, as well as the intensity or power of the radiation source, advantageously an IR radiation source, per unit of area of the treated piece of wood. In order to achieve a controllable system, however, the application method, pH value and concentration of the hydrogen peroxide must be right.

In order to cut the evaporation period of hydrogen peroxide, the hydrogen peroxide is fed onto the wood surface in the form of spray and in sufficiently small quantities. In the method according to the invention, hydrogen peroxide is sprayed onto wood surface in relatively small quantities, i.e. 5–60 g per square meter of the treated piece of wood. Said quantities are calculated for 50% hydrogen peroxide, which means that when the hydrogen peroxide concentration is changed, the application quantities are naturally changed, too. By means of the above described measures it is ensured that the hydrogen peroxide does not penetrate too deep in the wood, so that a sufficiently short evaporation time is achieved.

The spraying treatment and low hydrogen peroxide feed quantities bring forth distinctive advantages in comparison with the known methods, where an object is typically immersed in hydrogen peroxide; in case an object is immersed in hydrogen peroxide, the wood absorbs hydrogen peroxide to a remarkably greater amount, which means that the decomposition and removal of hydrogen peroxide requires much more time and energy than what is needed in the method of the present invention.

The pH of the initial solution of the hydrogen peroxide spray to be sprayed onto the wood surface must be neutral or acidic. Hydrogen peroxide is extremely active in acidic conditions, and its bleaching capacity is based on a hydroxonium ion (HO). Owing to the activity of hydrogen peroxide, the effective time of hydrogen peroxide can be extremely short.

The hydrogen peroxide concentration must not be too high, either, because it has been found to slow down the effects of hydrogen peroxide; hydrogen peroxide is suitably used as a 50% aqueous solution, i.e. as a normal stock solution.

By adjusting the time difference between the wood surface hydrogen peroxide spraying and hydrogen peroxide activation, also the wood surface lightness can be adjusted. Hydrogen peroxide is activated by irradiation advantageously by an IR radiation source. In practice the time difference between the hydrogen peroxide spraying and irradiation is generally controlled by adjusting the conveying speed of the conveyor line, such as a hanging conveyor or roller conveyors. At the moment of hydrogen peroxide spraying, the wood surface temperature must be room temperature or lower. The latter control factor is mainly adjusted by adjusting the temperature and volume flow of the air fed onto the wood surface.

Possible hydrogen peroxide residues are in the method of the invention decomposed by using heat, ultrasound and light, as well as by blasting air onto the wood surface, or by a combination of these. Hydrogen peroxide residues can be removed for instance by means of re-evaporation, which can be speeded up for example by heating the wood surface. However, usually it is not necessary to separately decompose or neutralise hydrogen peroxide after bleaching, which naturally is a remarkable advantage, because it reduces the number of process steps as well as the quantity of neutralising chemicals. In case there still is hydrogen peroxide left on the wood surface, the residues are decomposed immediately in order to prevent the wood from softening on the surface.

When adjusting the quality factors of a relatively thin wood surface, as is the case with plywood, for example, it is advantageous, prior to the hydrogen peroxide spraying, to perform a short preheating in order to raise the wood surface temperature up to about room temperature. Among the wood preheating methods let us point out irradiation by various radiation sources; IR radiation, heating with halogen lamps, microwave heating, air heating for instance in a return air stove as well as heating in a protective gas, such as a hydrogen atmosphere, just to mention a few of the possible heating methods.

The heating of the wood surface after the hydrogen peroxide spraying up to a temperature of 40–80° C. is advantageously carried out by an IR radiation source with an intensity and wavelength profile that depends on the quality, hardness, thickness and species of the treated wood material, as well as on the wood surface pre-treatment conditions, the shape of the object to be bleached, the desired degree of lightness and the planned further treatment processes. For instance among solid woods, a suitable heating temperature for birch and beech is 40–80C., for spruce and pine about 40° C. or less. As regards spruce and pine, the heating temperature is above all restricted by the melting of resin. For birch plywood, suitable heating temperatures are within the range of 40–80° C. For parquets, a suitable temperature is 60–80° C., depending on the type of parquet, so that birch parquet allows the use of higher temperatures than for example pine or spruce parquet.

In the method of the invention, the colour shades and particularly lightness of plywood can often be adjusted by treating the recently rotary-cut and still moist plywood with hydrogen peroxide, and by thereafter raising the plywood temperature momentarily up to 40–80° C. Now the plywood can be dried in the ordinary way. However, detailed process choices depend largely on the object to be bleached (solid wood, laminated wood, veneer, plywood etc.), on the desired degree of lightness and the pre-treatment of the wood (for instance soaking conditions as regards the production of plywood). Further below, the present application introduces more exemplary process conditions for chosen wood products and semi-finished products. The method can likewise be applied to the bleaching of the surface of other species of wood.

In case it is probable that hydrogen peroxide during the process gets into contact with heavy metal residues, such as Mln, Fe or Cu, which may weaken the effect of hydrogen peroxide by prematurely decomposing hydrogen peroxide, the decomposition can be prevented by stabilisers such as EDTA, DTPA. Na silicate or Mg salts, without restricting the method to these exclusively.

The effect of hydrogen peroxide can often be boosted by a small quantity of hydrogen peroxide activator, such as alcohol, quartenary ammonia salts, molybdenum, borohydride, nitrile amine, Na bicarbonate, persulphate or other known hydrogen peroxide activator agents or suitable bleaching agents such as oxygen, ammonia, ozone, dichromate, permanganate, Na thionate or formamide.

A yellowish tint of the wood surface after the hydrogen peroxide treatment can be prevented in connection with the hydrogen peroxide treatment or thereafter by feeding on the wood surface UV stabilisers or antioxidants, for instance triazole derivatives, mercaptans, sugars, phenol acids, polyglycols, polytetrahydrofuran, boron hydrides or phenols.

In the method according to the invention, hydrogen peroxide solution is sprayed onto the wood surface in acidic conditions. Because the pH value of a 50% commercial hydrogen peroxide solution is 2–3, in most cases the commercial solution can as such be used in the process, which naturally is a great advantage with respect to the operating costs of the process, because the steps of adjusting the pH of the hydrogen peroxide solution and diluting the solution are left out or at least considerably diminished.

By means of the method of the invention, wood colour shades can be effectively adjusted and hence colour defects and uneven coloration can be eliminated, and an even absorption of pigments and paints can be improved. An even absorption of pigments and paints is possible, because the hydrogen peroxide treatment opens the wood pores, so that the absorption of varnishes, primers, priming paints and pigments takes place evenly and rapidly. For instance the staining of wood results in a more uniform quality, when the thinner is absorbed evenly in the wood.

Particularly feasible the method is when removing colour defects from plywood. Plywood often obtains reddish or yellowish shades, among others because the soaking of the plywood prior to rotary cutting has not been completely successful. In the method according to the invention, plywood can be bleached through, which process removes defects that were created in the production process.

With certain wood species and products, their resistance to UV radiation is clearly improved after the colour shades of the object in question are adjusted by means of the method according to the invention. It has been found out that the UV resistance of technically modified wood products, such as maleic-saturated and thermally treated wood products, among others, has improved. Likewise the gluing of such wood material that is bleached according to the present method is remarkably easier than normally, because the glue is absorbed in the wood evenly and effectively owing to the fact that the wood pores are well open.

In the adjusting method of wood surface quality factors according to the invention, the most important and only necessary bleaching agent is hydrogen peroxide, and in most cases auxiliary chemicals are not needed, in which case the operating costs of the process remain low.

As regards the technology of the method, the process according to the invention is simple, because complicated wood tempering and pH adjustment steps are left out.

With respect to the rest of the advantages of the method, let us point out the following:

By means of the method, the quality of wood material can be improved.

In case the wood material is darkened in the drying process, its lightness can be returned by means of the method.

The method is particularly interesting when evening out wood colours. In the heat treatment, the wood temperature is raised up to 150–300° C., in which case its capacity to absorb moisture is remarkably reduced. However, during the process various degrees of grey shades are created in the wood. By means of the current method, the grey shades of thermally treated wood can be removed and brownish shades can be made brighter.

By applying the method, the colour shades of nearly finished furniture as well as whole furniture blanks can be adjusted For example a ready-made table top can be treated in the process immediately prior to the final surface treatment, effectively and evenly onto the piece of furniture itself. Thereafter the colour of the final finishing agent is repeated on the wood surface exactly as desired, because the greyish shades are removed from the surface by means of the quality factor adjusting method according to the invention.

Also veneer coated with plywood is made clearly lighter by means of the method.

DETAILED DESCRIPTION OF THE INVENTION

The method according to the invention is described in more detail below with reference to the appended examples.

Figure 1:
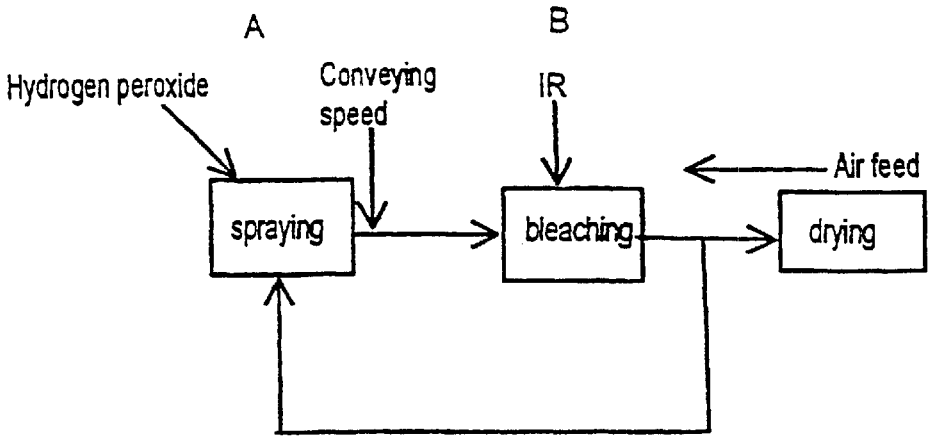
FIGS. 1 and 2 are schematic representations of a method for adjusting the quality factors of the surface of a piece of wood according to the invention.

Example 1, which is illustrated in FIG. 1, relates to the implementation of the method by a spraying line and IR radiation sources. Several successive spraying and heating cycles can be included in the method.

Figure 2:
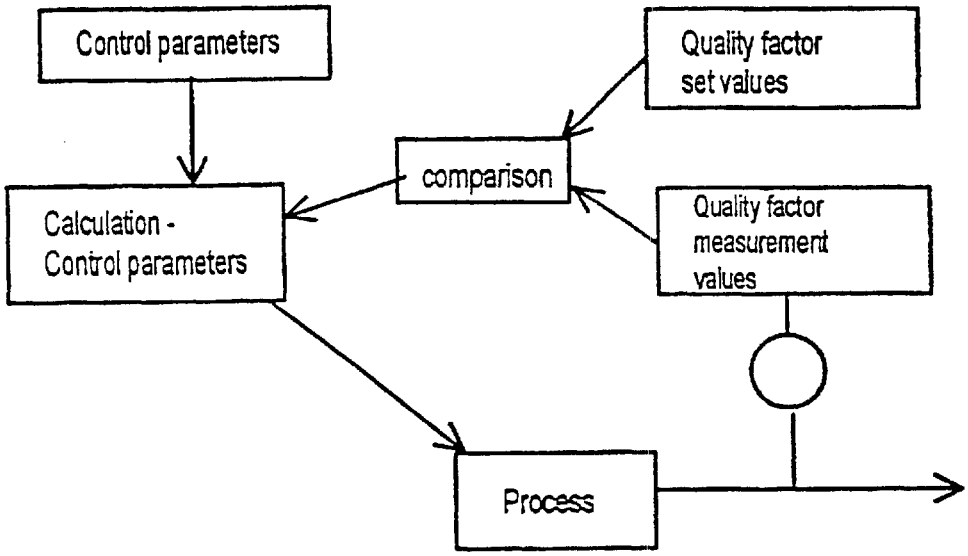

Example 2, which is illustrated in FIG. 2, relates to the implementation of the quality factor adjusting method according to the invention by a regular feed-back adjustment.

Example 3 is an example of practical usage and describes how the adjustment of birch parquet and thermally treated birch board is carried out according to the method of the invention.

EXAMPLE 1

In the method according to FIG. 1, onto the surface of a piece of wood, there was sprayed hydrogen peroxide vapour with a spray pistol at the spraying step A, while the wood surface temperature was about 20° C. The quantity of 50% hydrogen peroxide per surface area unit of the wood to be bleached varied within the range 10–40 g/m$^2$. Thereafter, after a period $\Delta T$, the piece of wood was transferred to the bleaching step B. The time between steps A and B was adjusted by controlling the proceeding speed of the conveying track. In step B, the wood surface was irradiated by an IR heating element with a total heating capacity of 40 kW and average radiation intensity 10 kW/m$^2$ in order to adjust the wood surface temperature up to 40–80° C., and simultaneously cooling air was blasted onto the wood surface. Air is blasted during the IR irradiation, because the radiation intensities used in the process surpass considerably the intensities that are normally used in the wood processing industry (less than 20 kW), in which case the wood surface is easily overheated, if additional cooling is not provided. At the end of the bleaching step, the wood surface could be irradiated once more with the light source in order to prevent the decomposition of hydrogen peroxide.

When necessary, the vapour spraying line according to FIG. 1 may include even more alternating spraying/heating cycles, in which case after each heating cycle, possible hydrogen peroxide residues are removed by blasting air onto the surface of the piece of wood. Further heating/cooling cycles may be remarkably shorter than the first and primary heating/cooling cycle.

EXAMPLE 2

In the adjusting method of whole wood quality factors according to FIG. 2, the wood surface quality factors such as colour shades (lightness or reflectivity, porosity, uniformity of colours) are measured at the wood surface, for instance in a process according to FIG. 1, in succession to the thermal treatment step B, by means of machine vision. Said measured values of the quality factors are compared with the set values of the same quality factors, recorded in a database. The difference between the measured and set values of the quality factors is fed to a calculation programme, where also the actual values of the control factors red. The calculation programme calculates new values for the process control factors, whereafter either the same piece of wood is re-treated with new control factors (the repeated spraying/heating cycle illustrated in FIG. 1) or the next piece of wood is fed to the process in order to be treated according to new control factors. Typical set values to be changed by the method 2 are for example the quantity and temperature of the air fed into the wood surface irradiation heating) step: by reducing the air flow and by raising the temperature of the blasted air, a lighter and more porous wood is obtained.

EXAMPLE 3

Tables 1 and 2 contain the results from adjusting the colour shades of birch parquet and thermally treated birch parquet by means of the quality factor adjusting method according to the invention.

The following process control factor values were used in the method:

- Hydrogen peroxide was used as a 50% stock solution with a pH of 2–6, the feed quantity onto the wood surface was 40 g per m$^2$ of the surface. Application (distribution) was carried out by spraying hydrogen peroxide onto wood surfaces having room temperature.
- The radiation source was an IR radiator with a power of about 100 kW per m$^2$ of the wood surface and with a maximum emission of 3–6 $\mu$m.
- The final wood surface temperature at the end of the irradiation step was 40–80° C.
- The total effective period of hydrogen peroxide from its application to its evaporation from the wood surface was less than 60 seconds.
- The effective period of hydrogen peroxide from its spraying onto the wood surface to its activation was less than 10 seconds.
- During the heating/radiation, cooling air was blasted onto the wood surface.

TABLE 1

| | Birch parquet | | | | | | | | |
|---|---|---|---|---|---|---|---|---|---|
| | Treatment C | | | Treatment B | | | Treatment A | | |
| | bl. | neutr. | change % | bl. | neutr. | change % | bl. | neutr. | change % |
| $L^1$ | 85.4 | 82.2 | 3.9 | 84.5 | 81.5 | 3.6 | 83.1 | 81.9 | 1.4 |
| $a^2$ | 2.1 | 3.7 | −44.2 | 2.8 | 4.2 | −33.8 | 3.2 | 4.0 | −18.0 |
| $b^3$ | 18.4 | 18.7 | −1.8 | 18.1 | 19.3 | −6.4 | 19.1 | 19.1 | −0.4 |
| $n^4$ | 30 | 30 | | 30 | 30 | | 30 | 30 | |

TABLE 2

| | Thermally treated birch board | | | | | | | | | | | |
|---|---|---|---|---|---|---|---|---|---|---|---|---|
| | Board 1 | | | Board 2 | | | Board 3 | | | Board 4 | | |
| | bl. | neutr. | change % | bl. | neutr. | change % | bl. | neutr. | change % | bl. | neutr. | change % |
| $L^1$ | 65.0 | 57.2 | 13.6 | 63.1 | 52.0 | 21.2 | 67.2 | 58.1 | 15.6 | 65.0 | 57.3 | 13.5 |
| $a^2$ | 10.0 | 10.0 | −0.3 | 10.3 | 11.5 | −10.5 | 9.4 | 10.5 | −10.5 | 9.7 | 10.1 | −4.3 |
| $b^3$ | 28.4 | 24.5 | 15.9 | 29.0 | 25.0 | 15.7 | 28.1 | 26.1 | 7.6 | 27.7 | 25.5 | 8.7 |
| $n^4$ | 10 | 10 | | 10 | 10 | | 10 | 10 | | 10 | 10 | |

Abbreviations: bleached=bl., neutr.=neutral and change %=percentage of change.

$L^1$: brightness; min 0, max 100, $a^2$: greenness—redness; negative values of a indicate greenness and positive redness; $b^3$: blueness—yellowness; negative values of b indicate blueness, positive yellowness (the scale of a and b is −60–+60), and n is the number of measurements. In the table the values of L, a and b are averages of several measurements; n is the number of measurements.

The treatment A in the tables means the basic treatment.

In the treatment B of the tables, the process control factors were adjusted so that the hydrogen peroxide feed quantity per surface $m^2$ was increased by 30%, the absorption time of the hydrogen peroxide spray prior to its activation by IR radiation was increased from 5 to 8 seconds, and the power of the IR radiation source was increased by 20%.

In the treatment C of the table, the hydrogen peroxide feed quantity was increased by 80% with respect to the treatment A, the absorption time was extended up to 10 seconds and the power of the IR radiation source was increased by 50%. Moreover, the irradiation time was doubled, and the cooling air flow speed was increased.

Experimental arrangements: the exemplary treatments of the wood products dealt with in both tables were carried out for ready-made wood surfaces having room temperature. The samples were treated so that the hydrogen peroxide treated wood surface and the untreated (reference) wood surface were of the same type of wood. After colour adjustments, both sides were lightly sandpapered to the same coarseness of surface, and on both sides there were carried out a number of local colour shade measurements, corresponding to the number indicated in column n, at various points. The measurements were carried out by a Minolta CM-2002 spectrophotometer, by the CIELAB method, standard Observer 2°, standard Illuminant D65. The values given in the tables are averages of measurement values, when the number of measurements is given in column n.

The tables represent the changing of the various colour components of the wood colour shade as a result of each treatment, and the results are given as percentages in relation to untreated wood. Table 1 proves that for example the redness of birch parquet can be reduced and brightness increased by means of the quality factor adjusting method according to the invention. Table 2 represents an intensive colour adjustment method that is suitable for thermally treated birch board. The dark brown basic colour and brightness of thermally treated birch board could be adjusted in a large area by changing, among the process control parameters, the power of the IR radiation source, the period between the hydrogen peroxide spraying and its activation, as well as the hydrogen peroxide feed quantity.

What is claimed is:

1. A method for adjusting the quality factors of the surface of a piece of wood so that the effective time of hydrogen peroxide, from its application onto the wood surface to its evaporation therefrom is less than 5 minutes, which comprises:

spraying an initial solution of hydrogen peroxide onto the surface of the piece of wood having a temperature near room temperature or lower; the initial solution having a neutral or acidic pH;

allowing the hydrogen peroxide to affect the wood surface for about 1–60 seconds; and activating the hydrogen peroxide by irradiating the surface of the piece of wood with a radiation source, so that its surface temperature at the end of the irradiation is 40–80° C.

2. The method according to claim 1, further comprising:

measuring the wood surface quality factors;

comparing the measured values of the wood surface quality factors to set values of said quality factors; and on the basis of the difference between the measured values and the set values of the quality factors, making adjustments in the process control factors; the process control factors comprising one or several of the following: the quantity and temperature of the air fed onto the wood surface, the power of the radiation source, the duration between the spraying and activation of the hydrogen peroxide, the quantity and concentration of hydrogen peroxide vapor, and the pH value of the initial hydrogen peroxide solution.

3. The method according to claim 2, wherein after adjusting the process control factors, the wood surface quality factors are measured once or several times and compared to the quality factor set values, and on the basis of the difference between the measured values and the set values, the set values of the process are adjusted, until the desired wood surface quality factors are achieved.

4. The method according to claim 3, wherein prior to measuring the quality factors, the wood surface temperature is adjusted to be at approximately room temperature or less.

5. The method according to claim 4, wherein the wood surface temperature is adjusted to be at approximately room temperature or less by feeding air onto the wood surface.

6. The method according to claim 1, wherein the radiation source is an IR radiator with a maximum emission of 1–10 $\mu$m.

7. The method according to claim 6, wherein the maximum emission is 3–6 $\mu$m.

8. The method according to claim 1, wherein simultaneously with the wood surface irradiation, the wood surface is cooled by an air flow, so that the duration of the period from the activation of the hydrogen peroxide sprayed onto the wood surface to its evaporation is of the order of less than 5 minutes.

9. The method according to claim 8, wherein the duration of the period from the activation of the hydrogen peroxide sprayed onto the wood surface to its evaporation is less than 1 minute.

10. The method according to claim 1, wherein the quantity of hydrogen peroxide sprayed onto the wood surface is 5–60 g per $m^2$ of the wood surface.

11. The method according to claim 1, wherein the hydrogen peroxide is allowed to affect the wood surface for about 1–30 seconds.

12. The method according to claim 11, wherein the radiation source has a power of 20–500 kW per $m^2$ of the wood surface.

13. The method according to claim 12, wherein the power is 50–200 kW per $m^2$ of the wood surface.

* * * * *